US010857795B2

(12) United States Patent
Murayama et al.

(10) Patent No.: US 10,857,795 B2
(45) Date of Patent: Dec. 8, 2020

(54) LIQUID EJECTION HEAD, LIQUID EJECTION APPARATUS, AND METHOD OF MANUFACTURING LIQUID EJECTION HEAD

(71) Applicant: SEIKO EPSON CORPORATION, Tokyo (JP)

(72) Inventors: Toshiro Murayama, Suwa (JP); Yuma Fukuzawa, Matsumoto (JP); Shunya Fukuda, Azumino (JP); Kazuaki Uchida, Suwa (JP); Shunsuke Watanabe, Matsumoto (JP); Noriaki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/453,028

(22) Filed: Jun. 26, 2019

(65) Prior Publication Data

US 2020/0001608 A1 Jan. 2, 2020

(30) Foreign Application Priority Data

Jun. 29, 2018 (JP) ..... 2018-124190

(51) Int. Cl.
*B41J 2/14* (2006.01)

(52) U.S. Cl.
CPC ..... *B41J 2/14274* (2013.01)

(58) Field of Classification Search
CPC ... B41J 2/14274; B41J 2/1433; B41J 2/14314
See application file for complete search history.

(56) References Cited

U.S. PATENT DOCUMENTS

| | | | |
|---|---|---|---|
| 10,245,841 | B2 | 4/2019 | Asaka et al. |
| 2004/0041886 | A1 | 3/2004 | Suzuki |
| 2007/0024676 | A1 | 2/2007 | Kachi et al. |
| 2012/0176450 | A1 | 7/2012 | Akahane et al. |

(Continued)

FOREIGN PATENT DOCUMENTS

| | | |
|---|---|---|
| CN | 108025551 | 5/2018 |
| JP | 2007001194 | 1/2007 |

(Continued)

OTHER PUBLICATIONS

European Search Report issued in Application No. EP19182771 dated Nov. 26, 2019.

*Primary Examiner* — Jason S Uhlenhake
(74) *Attorney, Agent, or Firm* — Workman Nydegger

(57) ABSTRACT

A head includes a flow path substrate including a flow path of the liquid in the flow path substrate, a nozzle plate which is attached to the flow path substrate and in which the nozzle is formed, a pressure chamber substrate that is attached to a location facing the nozzle plate with the flow path substrate interposed therebetween and that has a pressure chamber, and a pressure generation portion that operates according to an electrical signal from a wiring substrate coupled to an electrode provided on the pressure chamber substrate and that changes a pressure of the pressure chamber to eject the liquid from the nozzle, in which the nozzle plate and the wiring substrate are disposed such that the nozzle plate does not overlap a coupling portion between the wiring substrate and the electrode when viewed in a thickness direction of the flow path substrate.

17 Claims, 6 Drawing Sheets

(56) References Cited

U.S. PATENT DOCUMENTS

| | | | |
|---|---|---|---|
| 2016/0243829 | A1 | 8/2016 | Naito et al. |
| 2017/0210130 | A1* | 7/2017 | Tanaka ..... B41J 2/14233 |
| 2017/0266972 | A1 | 9/2017 | Hirai et al. |
| 2018/0001638 | A1 | 4/2018 | Wang et al. |
| 2018/0257386 | A1 | 9/2018 | Asaka et al. |

FOREIGN PATENT DOCUMENTS

| | | | |
|---|---|---|---|
| JP | 2009143168 | | 7/2009 |
| JP | 2012-143948 | A | 2/2012 |
| WO | 2017047534 | | 3/2017 |
| WO | WO2017047534 | A2 * | 3/2017 |

* cited by examiner

LIQUID EJECTION HEAD, LIQUID EJECTION APPARATUS, AND METHOD OF MANUFACTURING LIQUID EJECTION HEAD

The present application is based on, and claims priority from JP Application Serial Number 2018-124190, filed Jun. 29, 2018, the disclosure of which is hereby incorporated by reference herein in its entirety.

BACKGROUND

1. Technical Field

The present disclosure relates to a liquid ejection head, a liquid ejection apparatus, and a method of manufacturing the liquid ejection head.

2. Related Art

In a liquid ejection apparatus that ejects liquid from a nozzle, a nozzle plate having the nozzle and a pressure generation portion coupled to a pressure chamber may be coupled to a flow path substrate having a flow path therein. In the liquid ejection apparatus, a wiring substrate having a drive circuit may be electrically coupled to a wire drawn out from a pressure generation portion. For example, JP-A-2012-143948 discloses a technology of driving the pressure generation portion using a drive signal supplied from the drive circuit via the wire to change a pressure of the pressure chamber, thereby, causing liquid to be ejected from the nozzle.

When the wiring substrate is mounted on the flow path substrate, a film-shaped adhesive called, for example, a non conductive film (NCF) or an anisotropic conductive film (ACF) is used for the liquid ejection apparatus. The wiring substrate is thermocompression-bonded to the wire drawn out from the pressure generation portion via the adhesive to be electrically coupled thereto. Accordingly, the flow path substrate receives a load due to thermocompression bonding at the time of this mounting, but according to the technology of the related art, it cannot be said that sufficient consideration is given to what effect this thermocompression bonding has on the flow path substrate. The inventor has found that there is a problem that damages or the like is caused to the nozzle plate coupled to the flow path substrate by the thermocompression bonding when the wiring substrate is mounted on the flow path substrate.

SUMMARY

According to an aspect of the present disclosure, a liquid ejection head having a nozzle for ejecting a liquid is provided. The liquid ejection head having a nozzle for ejecting a liquid includes a flow path substrate including a flow path of the liquid in the flow path substrate; a nozzle plate which is attached to the flow path substrate and in which the nozzle is formed; a pressure chamber substrate that is attached to a location facing the nozzle plate with the flow path substrate interposed therebetween and that has a pressure chamber; and a pressure generation portion that operates according to an electrical signal from a wiring substrate coupled to an electrode provided on the pressure chamber substrate and that changes a pressure of the pressure chamber to eject the liquid from the nozzle. The nozzle plate and the wiring substrate are disposed such that the nozzle plate does not overlap a coupling portion between the wiring substrate and the electrode when viewed in a thickness direction of the flow path substrate.

DESCRIPTION OF EXEMPLARY EMBODIMENTS

A. Embodiment

Figure 1:
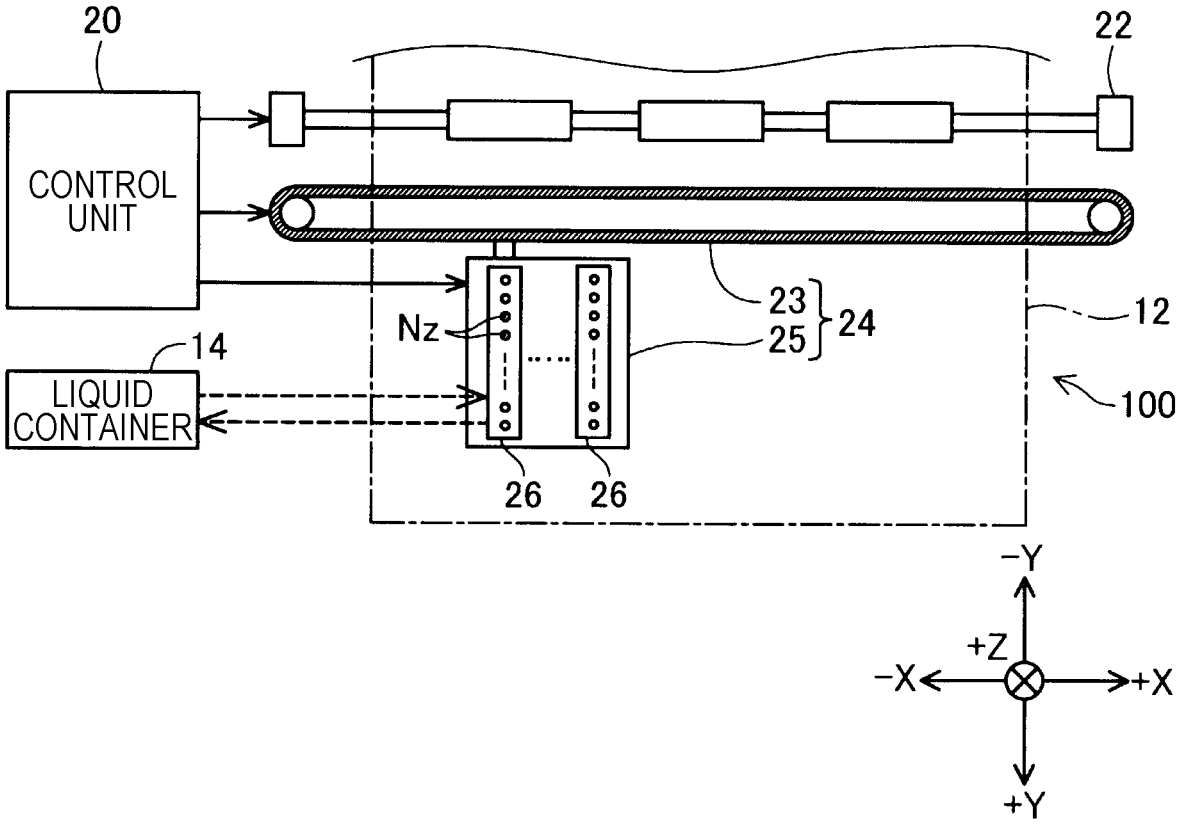
FIG. 1 is an explanatory diagram schematically illustrating a configuration of a liquid ejection apparatus according to a first embodiment.

FIG. 1 is an explanatory diagram schematically illustrating a configuration of a liquid ejection apparatus 100 according to a first embodiment. The liquid ejection apparatus 100 is an ink jet type printing apparatus that ejects droplets of ink, which is an example of a liquid, onto a medium 12 for printing. In addition to printing paper, a printing target of any material such as a resin film or cloth can be adopted as the medium 12. The X direction illustrated in FIG. 1 and each drawing subsequent thereto is a main scan direction along a transport direction of a liquid ejection head 26, and the Y direction is a sub scan direction that is orthogonal to the main scan direction and is a sending direction of the medium 12. The Z direction is an ink ejection direction and is parallel to the vertical direction in the present embodiment. In the following description, for the sake of convenient description, when the direction is specified, a positive direction is set to "+", a negative direction is set to "−", and signs of "+" and "−" are used together for a direction notation.

The liquid ejection apparatus 100 includes a liquid container 14, a transport mechanism 22 that send out the medium 12, a control unit 20, a head movement mechanism 24, and a liquid ejection head 26. The liquid container 14 individually stores a plurality of types of ink ejected from the liquid ejection head 26. The liquid container 14 includes a flow mechanism (not illustrated) configured by a pump. The liquid ejection apparatus 100 moves the ink through a flow path in the liquid ejection head 26 using the flow mechanism, ejects ink from a nozzle Nz, circulates the ink, and stores the ink again in the liquid container 14. A bag-like ink pack formed of a flexible film, an ink tank capable of replenishing ink, or the like can be used as the liquid container 14. The nozzle Nz is a circular through-hole through which the ink is ejected.

The control unit 20 includes a processing circuit such as a central processing unit (CPU) or a field programmable gate array (FPGA) and a memory circuit such as a semiconductor memory and collectively controls the transport mechanism 22, the head movement mechanism 24, and the liquid ejection head 26. The transport mechanism 22 operates under the control of the control unit 20 and transports the medium 12 in the Y direction.

The head movement mechanism 24 includes a transport belt 23 wound around a printing range of the medium 12 in the X direction, and a carriage 25 that contains the liquid ejection head 26 and fixes the liquid ejection head to the transport belt 23. The head movement mechanism 24 operates under the control of the control unit 20 and causes the liquid ejection head 26 to reciprocate together with the carriage 25 in the main scan direction. When the carriage 25 reciprocates, the carriage 25 is guided by a guide rail (not illustrated). A head configuration in which the liquid container 14 is mounted on the carriage 25 together with the liquid ejection head 26 may be adopted.

The liquid ejection head 26 is a stacking body in which head configuration members are stacked. As illustrated in FIG. 1, the liquid ejection head 26 includes nozzle rows in which rows of nozzles Nz are arranged in the sub-scan direction. The liquid ejection head 26 is prepared for each color of ink stored in the liquid container 14 and ejects ink supplied from the liquid container 14 from a plurality of nozzles Nz toward the medium 12 under the control of the control unit 20. A desirable image or the like is printed on the medium 12 by ejecting ink from the nozzles Nz during reciprocation of the liquid ejection head 26. Arrows denoted by broken lines in FIG. 1 schematically represent movement of ink between the liquid container 14 and the liquid ejection head 26. The liquid ejection head 26 according to the present embodiment circulates the ink using a flow mechanism not illustrated between the liquid ejection head and the liquid container 14.

Figure 2:
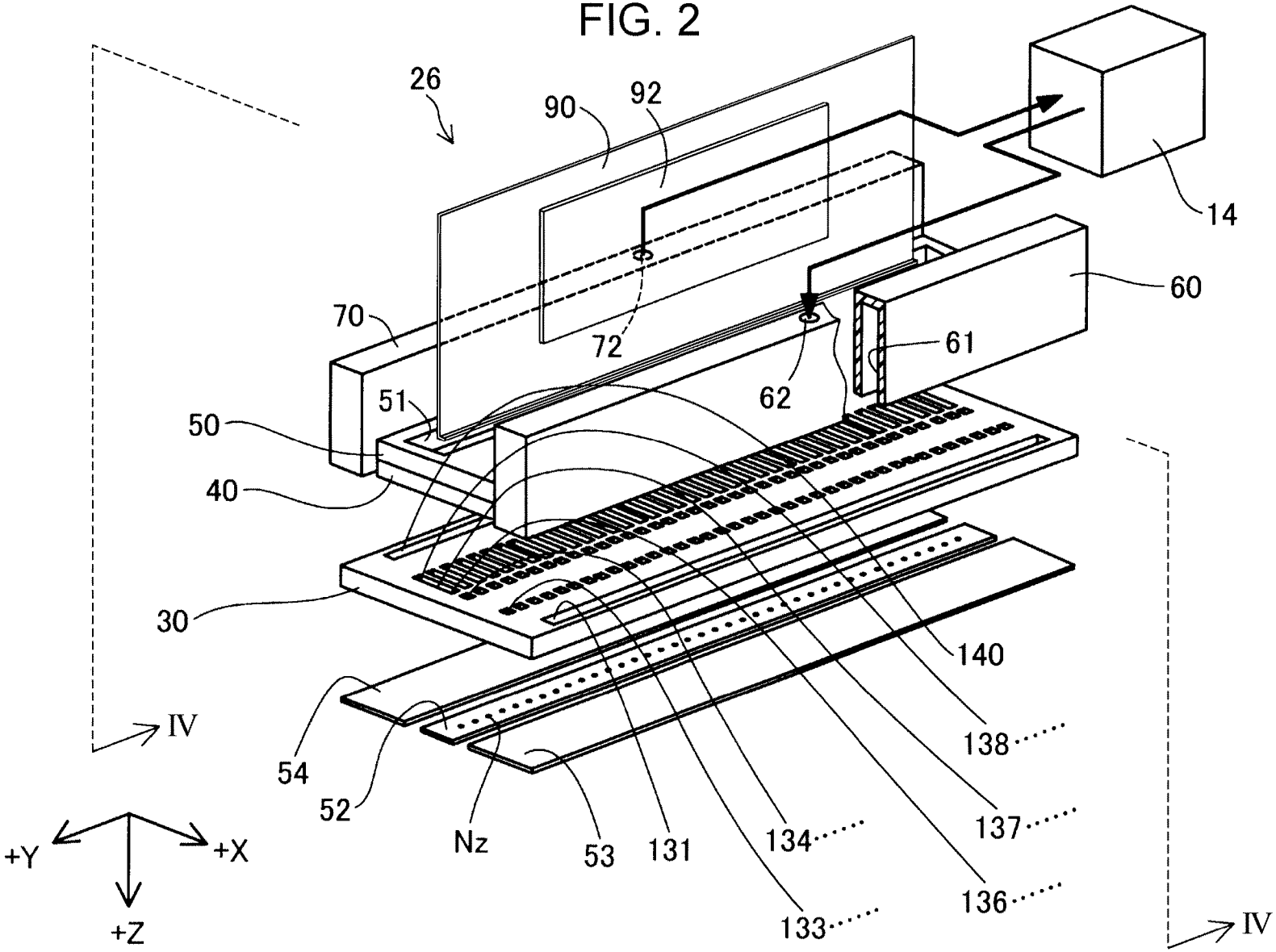
FIG. 2 is an exploded perspective view from an upper side of a main head configuration member of the liquid ejection head.
Figure 3:
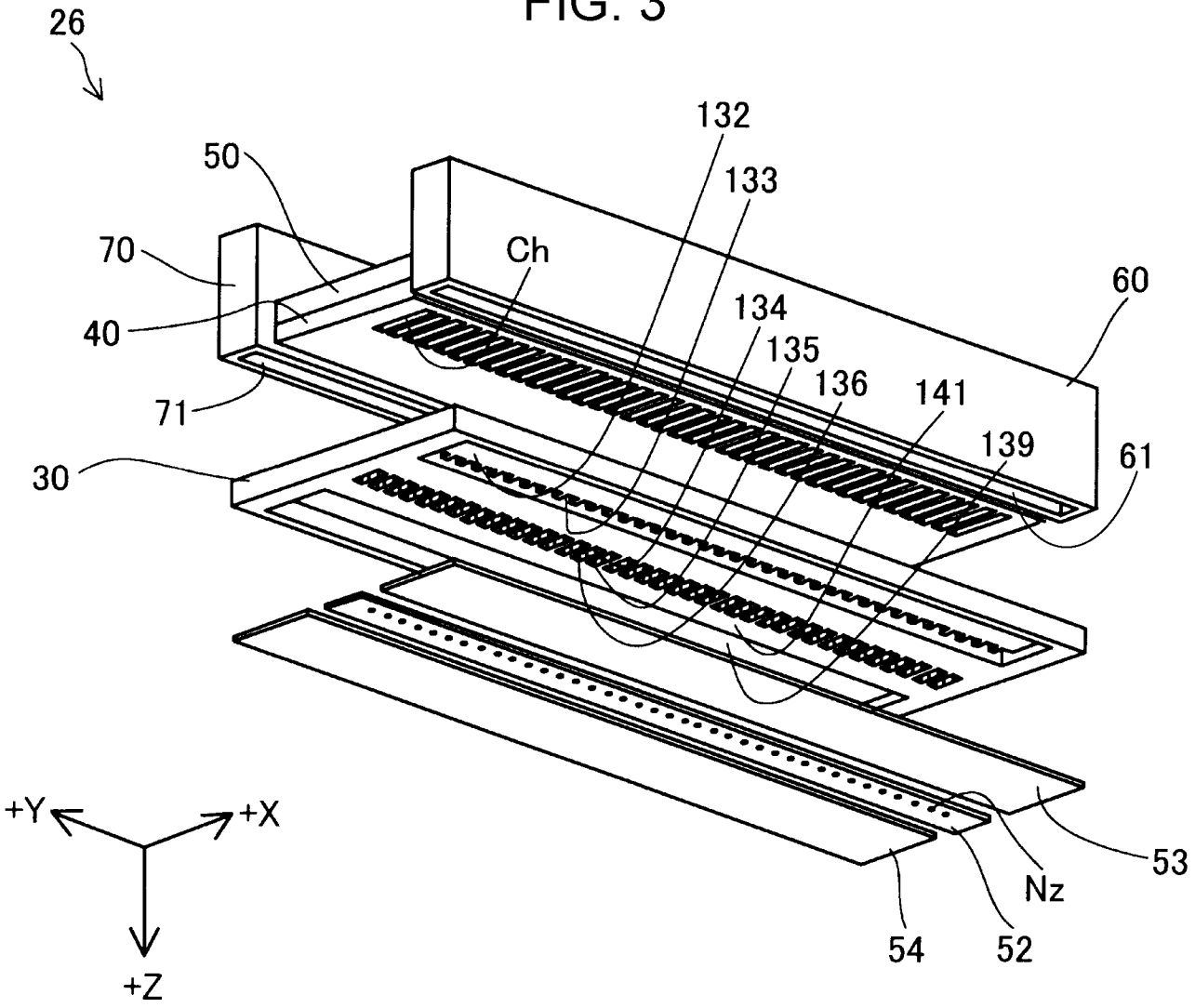
FIG. 3 is an exploded perspective view from a lower side of the main head configuration member of the liquid ejection head.
Figure 4:
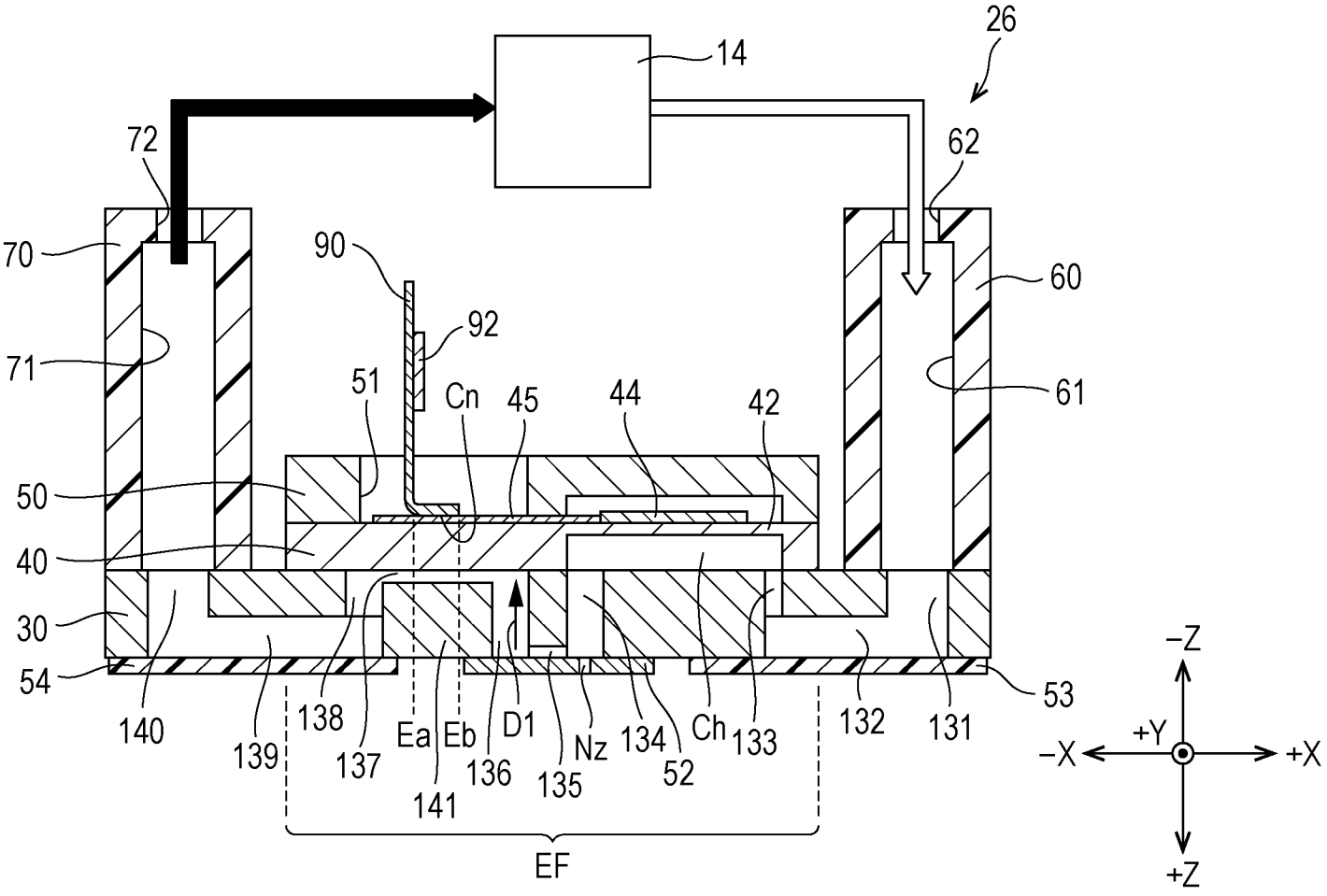
FIG. 4 is a cross-sectional view of the liquid ejection head taken along the line IV-IV of FIG. 2.

FIG. 2 is an exploded perspective view from an upper side of a main head configuration member of the liquid ejection head 26. FIG. 3 is an exploded perspective view from a lower side of the main head configuration member of the liquid ejection head 26. FIG. 4 is a cross-sectional view of the liquid ejection head 26 taken along line IV-IV in FIG. 2. A thickness of each the illustrated configuration members does not illustrate an actual thickness. Hereinafter, a flow path of the ink in the liquid ejection head 26 according to the present embodiment will be described with reference to FIGS. 2 to 4.

The liquid ejection head 26 includes a flow path substrate 30 in which a flow path of the ink is formed, a nozzle plate 52, a pressure chamber substrate 40, a protection member 50 for protecting a piezoelectric element 44, a first case member 60 for supply the ink, a second case member 70 for recovering the ink, a first vibration absorber 53, and a second vibration absorber 54.

The flow path substrate 30 is a planar plate body elongated in the Y direction. When an ink ejection direction side of the liquid ejection head 26 is set as a lower side, the first case member 60 and the second case member 70 are mounted on an upper surface of the flow path substrate 30, and the pressure chamber substrate 40 is coupled between the two case members. A nozzle plate 52 having the nozzles, the first vibration absorber 53, the second vibration absorber 54 are coupled at locations facing the pressure chamber substrate 40 on a lower surface of the flow path substrate 30 interposed therebetween. In the present embodiment, the flow path substrate 30 is a single crystal substrate formed of silicon. Various flow paths which will be described below are formed inside the flow path substrate 30 by applying a processing technology used for semiconductor manufacturing technology such as dry etching or wet etching. The flow path substrate 30 may be formed by three-dimensional modeling using a 3D printer, laser modeling or the like.

Various flow paths of the liquid ejection head 26 are formed by coupling through holes or concave grooves provided inside the flow path substrate 30 to the respective plate bodies. More specifically, by closing the concave groove on a lower surface of the plate with the nozzle plate 52, the first vibration absorber 53, or the second vibration absorber 54, a flow path is formed between the nozzle plate 52, the first vibration absorber 53, and the second vibration absorber 54. Hereinafter, configurations of the respective portions will be described in association with formation of the flow path from an upstream side which is an ink supply side to a downstream side which is a discharge side.

The first case member 60 is a plate body elongated in the Y direction and includes an ink receiving chamber 61 therein. The ink receiving chamber 61 is an elongated space in which a concave groove opened in the Z direction extends in the Y direction. The ink receiving chamber 61 configures a part of an ink storage chamber for receiving the ink supplied from the liquid container 14 via the ink introduction port 62. The first case member 60 is formed by injection molding of a resin material. As described above, in the liquid ejection head 26 according to the present embodiment, an upstream side of the ink circulation flow path is set as the ink receiving chamber 61, but the ink receiving chamber 61 may be set as the downstream side with the flow path reversed.

An ink flow path is formed inside the flow path substrate 30. More specifically, the flow path substrate 30 includes an ink inflow chamber 131, a first common flow path 132, a first supply path 133, a first communication path 134, a first individual flow path 135, a second communication path 136, a second individual flow path 137, a second supply path 138, a second common flow path 139, and an ink discharge chamber 140 in order from the upstream side.

As illustrated in FIG. 2, the ink inflow chamber 131 is a through hole having an elongated opening in the Y direction. As illustrated in FIG. 4, the first case member 60 is assembled to the flow path substrate 30 such that the ink inflow chamber 131 overlaps the ink receiving chamber 61. Thereby, the ink inflow chamber 131 is coupled to the ink receiving chamber 61.

As illustrated in FIGS. 3 and 4, the first common flow path 132 is an elongated concave groove formed on a lower surface side of the flow path substrate 30. The first common flow path 132 is coupled to the ink inflow chamber 131 to form one common liquid chamber. The first common flow path 132 is formed as a flow path by closing an opening portion on the lower surface side of a plate of the flow path substrate 30 by using the first vibration absorber 53. That is, a part of an inner wall of the first common flow path 132 is configured by the first vibration absorber 53.

The first vibration absorber 53 is a flexible planar film that absorbs pressure fluctuations in the ink inflow chamber 131 and the first common flow path 132. In the present embodiment, the first vibration absorber 53 is configured by a compliance substrate. Thereby, it possible to increase compliance of the common flow path configured by the ink inflow chamber 131 and the first common flow path 132 and to suppress occurrence of crosstalk when ink is ejected.

As illustrated in FIGS. 2 and 4, the first supply path 133 is a through-hole passing through the flow path substrate 30 and reaches the first common flow path 132. The number of the first supply paths 133 is equal to the number of the nozzles Nz for one first common flow path 132. Thereby, the first supply path 133 becomes a supply hole for branching from the first common flow path 132 to each individual flow path. The first supply path 133 is coupled to one end of a pressure chamber Ch provided for each nozzle Nz.

As illustrated in FIGS. 2 and 4, the pressure chamber Ch is a concave groove formed on a lower surface of the pressure chamber substrate 40. The pressure chamber Ch is a flow path surrounded by the groove of the pressure chamber substrate 40 and an upper surface of the flow path substrate 30 and is formed by coupling a lower surface of the pressure chamber substrate 40 to the upper surface of the flow path substrate 30. As described above, the pressure chamber Ch and the first supply path 133 are formed in the pressure chamber substrate 40 and on the first communication path 134 side which is a supply side of the flow path substrate 30 by a part of the pressure chamber substrate 40 and a part of the flow path substrate 30.

As illustrated in FIGS. 2 and 4, the first communication path 134 is a through-hole that passes through the flow path substrate 30 in a thickness direction and has an opening on the pressure chamber substrate 40 side and the nozzle plate 52 side of the flow path substrate 30. The first communication path 134 is a part of individual flow paths provided by the number of nozzles Nz. In the present embodiment, the opening on the lower surface side of the flow path substrate 30 among the openings of the first communication paths 134 is closed by the nozzle plate 52. The nozzle Nz is located at the opening of the first communication path 134 on the lower surface side of the flow path substrate 30. The opening on the upper surface side of the flow path substrate 30 among the openings of the first communication path 134 is closed by the pressure chamber substrate 40 and is coupled to the other end side of the pressure chamber Ch. Thereby, the pressure chamber Ch and the nozzle Nz communicate with each other through the first communication path 134.

The nozzle plate 52 is a plate-shaped member coupled to the lower surface side of the flow path substrate 30. The first communication path 134, the first individual flow path 135 and the second communication path 136 which will be described below are closed on the lower surface side of the plate of the flow path substrate 30. In the present embodiment, the nozzle plate 52 is a single crystal substrate formed of silicon. In the same manner as the flow path substrate 30, the nozzle plate 52 is formed with nozzles Nz in a row shape as illustrated in FIG. 2 by applying a processing technology. Thereby, it is possible to process the nozzle Nz with a high accuracy. In the present embodiment, an ejection direction of the ink by the nozzle Nz is the Z direction as described above, and a surface direction of the nozzle plate 52 is parallel to the XY plane perpendicular to the ejection direction.

As illustrated in FIGS. 3 and 4, the first individual flow path 135 is a concave groove formed on an interface side between the lower surface of the flow path substrate 30 and the upper surface of the nozzle plate 52 and is provided by the number of nozzles Nz. The first individual flow path 135 may be formed as a hollow flow path on the inner side of the flow path substrate 30 not on the interface side. The first individual flow path 135 may be formed across both the flow path substrate 30 and the pressure chamber substrate 40 on the interface side between the flow path substrate 30 and the nozzle plate 52 and may be formed on one surface side of either one of the flow path substrate 30 and the nozzle plate 52 like a concave groove formed on the upper surface of the nozzle plate 52. In the present embodiment, the first individual flow path 135 is coupled to the first communication path 134 on the lower surface of the flow path substrate 30, that is, on the nozzle plate 52 side. The first individual flow path 135 is formed as an individual flow path which closes the lower surface side of the flow path substrate 30 using the nozzle plate 52 and extends in a surface direction of the nozzle plate 52. Thereby, the first individual flow path 135 is formed such that an ink flow direction of the first individual flow path 135 is oriented in the X direction which is a direction perpendicular to the Z direction that is a direction of the ink ejected from the nozzle Nz. That is, a part of an inner wall of the first individual flow path 135 is configured by the nozzle plate 52. The first individual flow path 135 is a part of an individual flow path that functions as a discharge hole for making the ink flow on a downstream side that is subsequent to the nozzle Nz, that is, a discharge side. The first individual flow path 135 makes an end portion of the first communication path 134 on the nozzle plate 52 side communicate with an end portion of the second communication path 136 on the nozzle plate 52 side.

The second communication path 136 is a flow path coupled to the first individual flow path 135. The second communication path 136 is provided by the same number as the number of the nozzles Nz and configures a part of the individual flow path on the discharge side. As illustrated in FIGS. 2 and 4, the second communication path 136 is a through-hole that passes through the flow path substrate 30 in a thickness direction and has an opening on each of the pressure chamber substrate 40 side of the flow path substrate 30 and the nozzle plate 52. An arrow schematically indicating an ink flow direction D1 of the second communication path 136 is illustrated in the second communication path 136 of FIG. 4. In the present embodiment, since the second communication path 136 is a through-hole of the flow path substrate 30, a width of the second communication path 136 in the ink flow direction D1 is substantially the same as a thickness of the flow path substrate 30. In the present specification, the ink flow direction represents a direction in which the ink flows through a flow path when the flow path is viewed in macroscopic view.

The second individual flow path 137 is a flow path coupled to the second communication path 136 and is provided in the same number as the number of nozzles Nz. As illustrated in FIGS. 2 and 4, the second individual flow path 137 is a concave groove formed on an upper surface of the plate of the flow path substrate 30, that is, on an interface side between the flow path substrate 30 and the pressure chamber substrate 40. The second individual flow path 137 may be formed as a hollow flow path on the inner side of the flow path substrate 30 not on the interface side. The second individual flow path 137 may be formed across both the flow path substrate 30 and the pressure chamber substrate 40 on the interface side between the flow path substrate 30 and the pressure chamber substrate 40 or may be formed on one surface side of either the flow path substrate 30 or the pressure chamber substrate 40 like a concave groove formed on the upper surface side of the flow path substrate 30 or the lower surface side of the pressure chamber substrate 40. The second individual flow path 137 configures a part of the individual flow path on the discharge side rather than the nozzle Nz. In the present embodiment, one end of the second individual flow path 137 is coupled to the second communication path 136 on the upper surface side of the flow path substrate 30, that is, on the pressure chamber substrate 40 side. The second individual flow path 137 is closed by the pressure chamber substrate 40 and is formed as a flow path extending in the surface direction of the pressure chamber substrate 40. That is, a part of an inner wall of the second individual flow path 137 is configured by the pressure chamber substrate 40. The second individual flow path 137 is formed to be communicate with the second supply path 138.

As illustrated in FIGS. 2 and 4, the second supply path 138 is a through-hole that passes through the flow path substrate 30 and reaches the second common flow path 139. The second supply path 138 is a flow path coupled to the other end side of the second individual flow path 137 and communicates with the second common flow path 139. The second supply path 138 is a part of an individual flow path on the discharge side provided as many as the number of the nozzles Nz. Each of the second supply paths 138 is coupled to the second common flow path 139 which is one common liquid chamber. Thereby, the second supply path 138 functions as a supply hole from the individual flow path to the common liquid chamber on the discharge side, that is, an outlet on the discharge side of the individual flow path.

As described above, the individual flow path is configured with the first supply path 133, the pressure chamber Ch, the first communication path 134, the first individual flow path 135, the second communication path 136, the second individual flow path 137, and a second supply path 138. The nozzle Nz and a pressure generation portion are coupled in the individual flow path to configure one liquid ejection portion 80. In the liquid ejection head 26 according to the present embodiment, the liquid ejection portions 80 of the same number as the nozzles Nz are arranged in the Y direction that is a longitudinal direction of the flow path substrate 30. Thereby, ink can be ejected from the plurality of nozzles Nz, and a resolution for each liquid ejection head 26 can be increased.

As illustrated in FIGS. 3 and 4, the second common flow path 139 is one elongated concave groove formed on the lower surface side of the flow path substrate 30. The second common flow path 139 is coupled to the ink discharge chamber 140 to configure one common liquid chamber. The second common flow path 139 closes an opening portion on the lower surface side of the plate of the flow path substrate 30 using the second vibration absorber 54 to be formed as a flow path. That is, a part of an inner wall of the second common flow path 139 is configured by the second vibration absorber 54. The second vibration absorber 54 is a compliance substrate formed of the same material as the first vibration absorber 53. Thereby, it is possible to increase compliance of the common flow path on the discharge side configured by the ink discharge chamber 140 and the first common flow path 132, and to suppress occurrence of crosstalk when ink is ejected.

A plate mounting seat 141 is a part of the flow path substrate 30 formed by being surrounded by the first communication path 134, the second individual flow path 137, the second supply path 138, and the second common flow path 139 in a cross section of the flow path substrate 30 illustrated in FIG. 4. The plate mounting seat 141 configures a mounting seat for adhering the flow path substrate 30, the nozzle plate 52, and the second vibration absorber 54 to a wall surface on the lower surface side of the flow path substrate 30.

As illustrated in FIG. 2, the ink discharge chamber 140 is a through-hole having an elongated opening in the Y direction. As illustrated in FIG. 4, the ink discharge chamber 140 is configured by assembling the second case member 70 and the flow path substrate 30 so as to overlap an ink containing chamber 71. Thereby, the ink discharge chamber 140 is coupled to the ink containing chamber 71 in the second case member 70.

The second case member 70 is a plate body elongated in the Y direction and includes an ink containing chamber 71 therein. The ink containing chamber 71 is an elongated space in which a concave groove whose Z direction is opened extends in the Y direction. The ink containing chamber 71 receives the ink discharged from the ink discharge chamber 140 and configures a part of the ink storage chamber on the discharge side. The ink in the ink containing chamber 71 is refluxed to the liquid container 14 via the ink discharge hole 72, as indicated by a black arrow in FIG. 4. In the present embodiment, the second case member 70 is formed by injection molding using the same resin material as the first case member 60, but the second case member 70 and the first case member 60 may be formed of materials different from each other. The ink reflux from the second case member 70 is realized by a flow mechanism not illustrated. Mounting of the second case member 70 to the flow path substrate 30 is made liquid-tight by using an appropriate adhesive.

The pressure chamber substrate 40 is a plate body that forms the above-described pressure chamber Ch for each nozzle Nz. In the same manner as the flow path substrate 30, the pressure chamber substrate 40 can be formed through application of the above-described semiconductor manufacturing technology to a single crystal substrate formed of silicon. The pressure chamber substrate 40 includes a vibration portion 42 in addition to the pressure chamber Ch.

The vibration portion 42 is a wall surface of the pressure chamber Ch formed in a thin plate shape so as to be capable of vibrating elastically. The vibration portion 42 is provided on a surface of the pressure chamber substrate 40 on a side opposite to the flow path substrate 30 side and configures a part of the pressure chamber substrate 40 facing the pressure chamber Ch, that is, a wall surface which is a ceiling side of the pressure chamber Ch. A piezoelectric element 44 is provided for each pressure chamber Ch on a surface of the vibration portion 42 on a side opposite to the pressure chamber Ch side. Each piezoelectric element 44 is a passive element that individually corresponds to the nozzle Nz and deforms upon receiving a drive signal. The piezoelectric element 44 is disposed in the vibration portion 42 in association with the arrangement of the nozzles Nz and functions as a pressure generation portion. Vibration of the piezoelectric element 44 transmits a vibration portion 42 to cause a pressure change in the ink filled in the pressure chamber Ch. The pressure change reaches the nozzle Nz via the first communication path 134, and thereby, the ink is ejected from the nozzle Nz. In the present embodiment, the piezoelectric element 44 is provided on a surface of the pressure chamber substrate 40 on a side opposite to a side having the pressure chamber Ch, that is, on an upper surface side of the pressure chamber substrate 40. Thereby, a distance between a wiring substrate 90 and a pressure generation portion is shortened and coupling to a lead electrode 45 is easily made.

The protection member 50 fixes the lead electrode 45 electrically coupled to the piezoelectric element 44 for each pressure chamber Ch to the pressure chamber substrate 40 while interposing the pressure chamber substrate 40. As illustrated in FIG. 2, the protection member 50 is a plate body elongated in the Y direction, forms a concave space on the upper surface side of the vibration portion 42, and covers the vibration portion 42 together with the piezoelectric element 44. The protection member 50 is formed by injection molding of an appropriate resin material. The protection member 50 has a rectangular through-hole 51 elongated in the Y direction for installation of the wiring substrate 90 in electrical contact with the lead electrode 45.

As illustrated in FIG. 2, the wiring substrate 90 is a single flexible substrate whose longitudinal direction is the Y direction. A planar drive circuit 92 configured by a drive IC is provided on one surface of the wiring substrate 90. In the present embodiment, the wiring substrate 90 receives a drive signal output from the control unit 20 from the drive circuit 92 and supplies the drive signal to each of the piezoelectric elements 44 via the lead electrode 45. The wiring substrate 90 is thermocompression-bonded to the lead electrode 45 drawn out from a pressure generation portion via an adhesive and is electrically coupled to the lead electrode 45. In the present embodiment, a non conductive film (NCF) which is a film type adhesive is used as the adhesive. An anisotropic conductive film (ACF) may be used for the adhesive. FIG. 4 illustrates the wiring substrate 90 and a coupling portion Cn which is a location electrically coupled to the lead electrode 45. More specifically, the coupling portion Cn is a region in which the wiring substrate 90 and is coupled to the lead electrode 45 and which is interposed between an end portion Ea on the −X direction side and an end portion Eb on the +X direction side. The wiring substrate 90 is bent in a direction along a surface of the lead electrode 45 at an end portion on the Z direction side to protect a region for configuring the coupling portion Cn. The wiring substrate 90 includes the coupling portion Cn corresponding to the respective pressure generation portions of a plurality of liquid ejection portions 80 in the Y direction which is a longitudinal direction of the flow path substrate 30 and is electrically coupled to the lead electrode 45 of each of the liquid ejection portions 80. At this time, the wiring substrate 90 is mounted on the flow path substrate 30 in a state where a lateral direction is the Z direction which is a thickness direction of the flow path substrate.

In the liquid ejection head 26 according to the present embodiment, the ink supplied from the liquid container 14 by a flow mechanism not illustrated flows into the ink inflow chamber 131 and the first common flow path 132 of the flow path substrate 30 via the ink receiving chamber 61 of the first case member 60 and fills the ink inflow chamber 131 and the first common flow path 132 which are shared supply paths. The ink filled in the shared supply path is extruded into the individual flow path for each nozzle Nz by the continuously supplied ink and is supplied to the liquid ejection portion 80. More specifically, the extruded ink is branched to be supplied to each of the first supply paths 133 which are inlets of the individual flow paths and is supplied to each of the pressure chambers Ch. In the pressure chamber Ch, the ink is ejected from the nozzle Nz in response to vibration of the piezoelectric element 44 driven and controlled by the control unit 20. Supply of the ink from the liquid container 14 is continued even under a printing situation in which the ink is being ejected from the nozzle Nz and even in a situation without ink ejection from the nozzle Nz.

In a situation in which the supply of the ink to the pressure chamber Ch is continuing, the ink not ejected from the nozzle Nz flows through a flow path on the discharge side which is subsequent to the nozzle Nz. More specifically, the ink flows from the first communication path 134 to the first individual flow path 135, passes through the second communication path 136 and the second supply path 138, is extruded into the second common flow path 139 and the ink discharge chamber 140 which are common liquid chambers, and is sent out to the ink containing chamber 71 of the second case member 70. Thereafter, the ink is refluxed to the liquid container 14.

Figure 5:
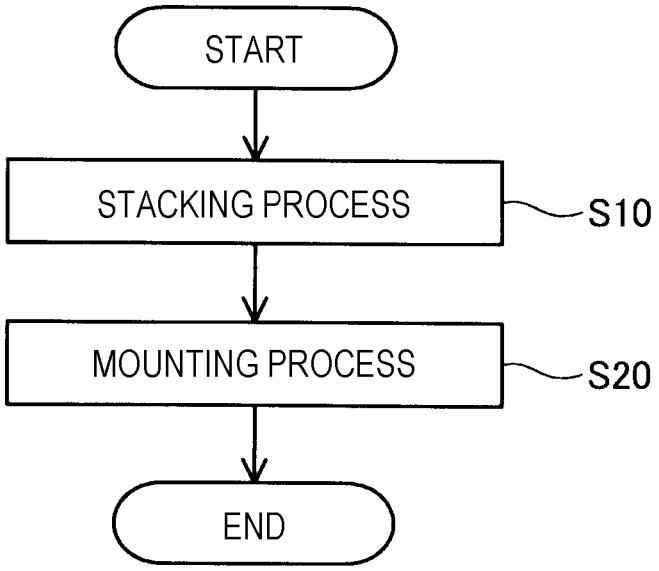
FIG. 5 is a flowchart illustrating a method of manufacturing the liquid ejection head according to the present embodiment.

FIG. 5 is a flowchart illustrating a method of manufacturing the liquid ejection head 26 according to the present embodiment. In step S10, the planar flow path substrate 30 having a flow path for ink therein, the nozzle plate 52 having the nozzle Nz formed therein, the pressure chamber substrate 40 having the pressure chamber Ch, and a pressure generation portion configured by the piezoelectric element 44 are adhered with an adhesive and stacked to each other. At this time, the nozzle plate 52 is aligned at a location where the nozzle Nz communicates with the first communication path 134 and is attached to one surface of the flow path substrate 30. The pressure chamber substrate 40 is attached to the other surface of the flow path substrate 30, that is, a location facing the nozzle plate 52 across the flow path substrate 30. The pressure generation portion is provided on the upper surface side of the pressure chamber substrate 40. In the method of manufacturing the liquid ejection head 26 according to the present embodiment, the flow path substrate 30, the nozzle plate 52, the pressure chamber substrate 40, and the pressure generation portion are stacked in this order, but the order of stacking may be in any order. In step S20, the wiring substrate 90 is mounted on a stacking body of the flow path substrate 30, the nozzle plate 52, the pressure chamber substrate 40, and the pressure generation portion described above. More specifically, the wiring substrate 90 is thermocompression-bonded to the lead electrode 45 drawn out from the pressure generation portion via an adhesive and is mounted on the stacking body. At this time, the wiring substrate 90 is mounted at a location where the nozzle plate 52 does not overlap the coupling portion between the wiring substrate 90 and the lead electrode 45 when viewed in a thickness direction of the flow path substrate 30.

Figure 6:
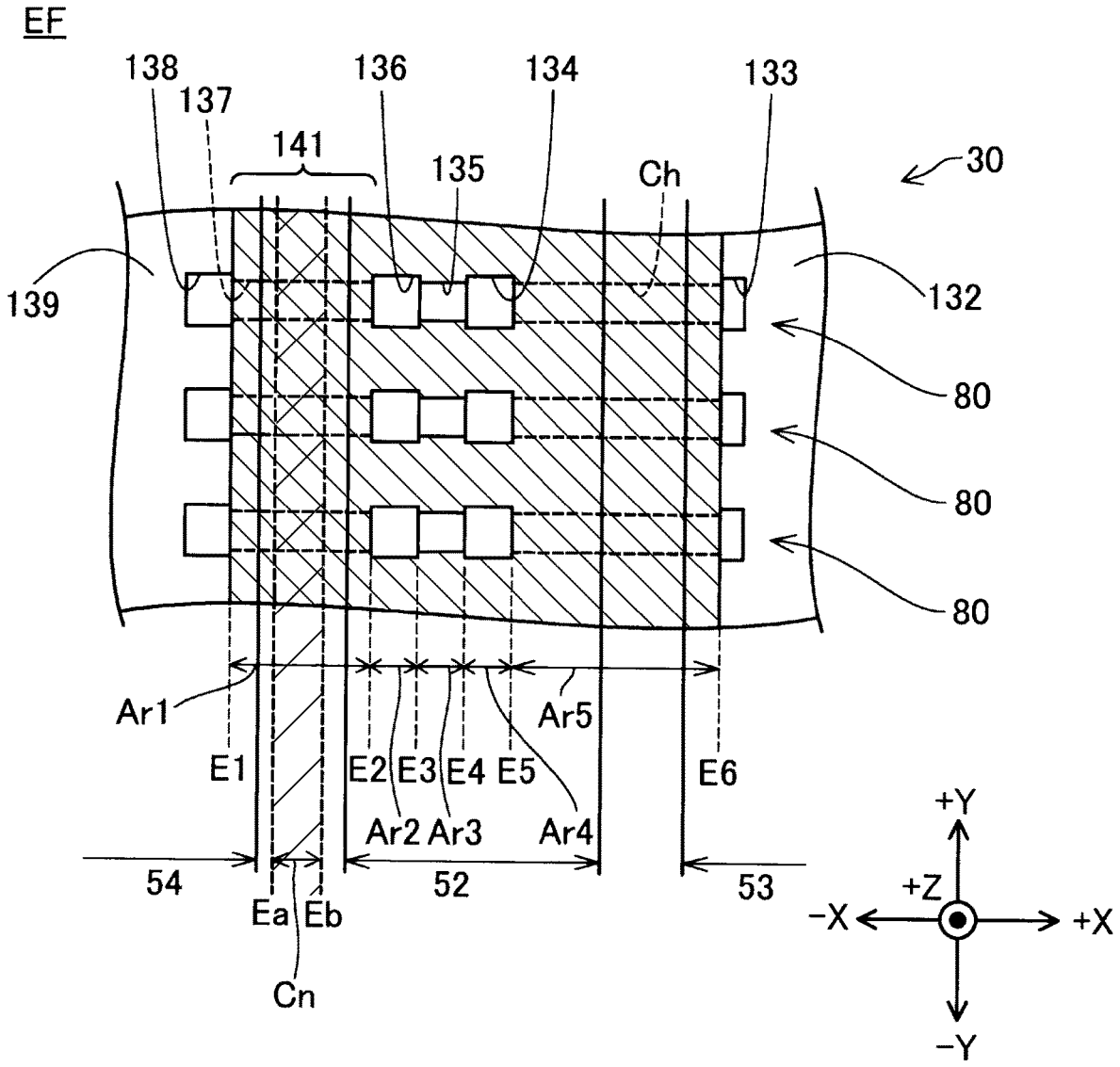
FIG. 6 is an explanatory diagram illustrating a surface of the liquid ejection head in a +Z direction.

FIG. 6 is an explanatory diagram illustrating a region EF on a surface on the +Z direction side of the liquid ejection head 26 of FIG. 4. That is, FIG. 6 illustrates a front view of the liquid ejection head 26 when the flow path substrate 30 is viewed in the +Z direction along the thickness direction. Hereinafter, a location relationship between the respective portions included in the liquid ejection head 26 according to the present embodiment will be described in detail with reference to FIG. 4 together with FIG. 6.

In FIG. 6, in order to facilitate understanding of a technology, the nozzle plate 52, the first vibration absorber 53, and the second vibration absorber 54 are not illustrated, and locations where these are arranged are schematically illustrated. E1 to E6 denoted by dashed lines in FIG. 6 represent locations of end portions of the respective portions added for the sake of convenient description. The end portion E1 is an end portion on the +X direction side of the second common flow path 139. The end portion E2 is an end portion on the −X direction side of the second communication path 136. The end portion E3 is an end portion on the +X direction side of the second communication path 136. The end portion E4 is an end portion on the −X direction side of the first communication path 134. The end portion E5 is an end portion on the +X direction side of the first communication path 134. The end portion E6 is an end portion on the −X direction side of the first common flow path 132. Ar1 to Ar5 illustrated in FIG. 6 are regions added for the sake of convenient description and represent regions surrounded by the end portions E1 to E6 in the X direction. In FIG. 6, for the sake of convenient description, a coupling portion Cn between the wiring substrate 90 and the lead electrode 45 is represented by cross hatching, and an end portion Ea on the −X direction side of the above-described coupling portion Cn and an end portion Eb on the +X direction side of the coupling portion Cn are also illustrated together.

The region Ar1 is interposed between the end portion E1 and the end portion E2. The region Ar1 configures the plate mounting seat 141 for bonding the second vibration absorber 54 and the nozzle plate 52 to the flow path substrate 30. The end portion on the +X direction side of the second vibration absorber 54 affixed to the flow path substrate 30 and the end portion on the −X direction side of the nozzle plate 52 are located at the region Ar1.

The region Ar2 is interposed between the end portion E2 and the end portion E3. That is, a width of the region Ar2 in the X direction is equal to a width of the second communication path 136 in the X direction. As described above, in the liquid ejection head 26 according to the present embodiment, the width of the second communication path 136 in the ink flow direction D1 is substantially the same as a thickness of the flow path substrate 30. When comparing the width, which is denoted by the region Ar2, of the second communication path 136 in the X direction with the width of the second communication path 136 illustrated in FIG. 4 in the ink flow direction D1, the width of the second communication path 136 in the ink flow direction D1, that is, the thickness of the flow path substrate 30 is greater.

The region Ar3 is interposed between the end portion E3 and the end portion E4. The region Ar2 and the region Ar3 are closed by the nozzle plate 52 affixed to the flow path substrate 30. The region Ar4 is interposed between the end portion E4 and the end portion E5. That is, a width of the region Ar4 in the X direction is equal to the width of the first communication path 134 in the X direction. The region Ar4 is a region which is blocked by the nozzle plate 52 and in which the nozzle Nz is disposed.

The region Ar5 is interposed between the end portion E5 and the end portion E6. The region Ar5 is a region where the first vibration absorber 53 and the nozzle plate 52 are bonded to the flow path substrate 30. The end portion on the +X direction side of the nozzle plate 52 and the end portion on the −X direction side of the first vibration absorber 53 affixed to the flow path substrate 30 are located in the region Ar5. As such, in the liquid ejection head 26 according to the present embodiment, the nozzle plate 52 has the nozzle Nz overlapped with the first communication path 134 of the region Ar4, the end portion on the −X direction side is affixed to the region Ar1, and the end portion on the +X direction side is affixed to the region Ar5.

In the present embodiment, the second communication path 136 communicates with an opening on the nozzle plate 52 side of the first communication path 134 via the first individual flow path 135 and extends toward the pressure chamber substrate 40 in a thickness direction of the flow path substrate 30. Thereby, the end portion E2 is formed on the flow path substrate 30. By forming the end portion E2, the plate mounting seat 141 is formed to secure a width of the region Ar1 for disposing the end on the +X direction side of the second vibration absorber 54 and the end portion on the −X direction side of the nozzle plate 52. Thereby, it is possible to provide a compact nozzle plate 52 for one flow path substrate 30. In the liquid ejection head 26 according to the present embodiment, when the flow path substrate 30 is viewed in the Z direction which is the thickness direction, a coupling portion Cn of the wiring substrate 90 and the lead electrode 45 is formed in the plate mounting seat 141. At this time, the coupling portion Cn and the nozzle plate 52 are disposed at locations not overlapping each other. That is, in the thickness direction of the flow path substrate 30, the wiring substrate 90 and the nozzle plate 52 do not overlap each other, and the drive circuit 92 and the nozzle plate 52 are also disposed at locations not overlapping each other.

In the present embodiment, the wiring substrate 90 is mounted on the flow path substrate 30 in a state where the pressure chamber substrate 40 and the nozzle plate 52 are stacked on the flow path substrate 30. At this time, a support location of the flow path substrate 30 when mounting the wiring substrate 90 on the flow path substrate 30 is a location in the Z direction which is the thickness direction of the flow path substrate 30 from a location coupling the wiring substrate 90 to an electrode, is a location facing the wiring substrate 90 with the flow path substrate 30 interposed therebetween, that is, a region corresponding to the coupling portion Cn in the plate mounting seat 141 and is a region of a hatched portion in the drawing. According to the liquid ejection head 26 of this aspect, the flow path substrate 30 and the wiring substrate 90 are disposed to be at locations not overlapping each other at a location in the thickness direction of the flow path substrate 30. Thus, when mounting the wiring substrate 90 on the flow path substrate 30 on which the nozzle plate 52 is mounted, it is possible to suppress occurrence of abnormality such as damaging the nozzle plate 52. A direction in which a load is applied when the wiring substrate 90 is mounted on the flow path substrate 30 is often determined in a surface direction of the drive circuit 92 mounted on the wiring substrate 90. According to the liquid ejection head 26 of the present embodiment, the drive circuit 92 mounted on the wiring substrate 90 and the nozzle plate 52 are disposed at locations not overlapping each other at a location in the thickness direction of the flow path substrate 30. Accordingly, it is possible to avoid disposing the nozzle plate 52 at a location matching the direction in which a load is applied to the wiring substrate 90 at the time of mounting. Thus, it is possible to suppress occurrence of abnormality such as damaging the nozzle plate 52 due to a weight of the drive circuit when mounting the wiring substrate 90 on the flow path substrate 30 on which the nozzle plate 52 is mounted and after the mounting.

According to the liquid ejection head 26 of the present embodiment, a plurality of liquid ejection portions 80 are arranged in the Y direction which is a longitudinal direction of the flow path substrate 30. Thereby, damage to the nozzle plate 52 at the time of mounting the wiring substrate can be avoided on the whole flow path substrate 30. Since a wall surface between the individual flow paths of each of the plurality of liquid ejection portions 80 is obtained, the wall surfaces play the same role as a beam, and thereby, strength of the flow path substrate 30 in the Z direction which is the thickness direction is enhanced. Thus, it is possible to increase a load when the wiring substrate 90 is mounted on the flow path substrate 30, and to reduce occurrence of the coupling failure between the wiring substrate 90 and the electrode.

In the liquid ejection head 26 according to the present embodiment, the second vibration absorber 54 and the coupling portion Cn are disposed at locations not overlapping each other when viewed in the Z direction. In the same manner as the second vibration absorber 54, the first vibration absorber 53 is also disposed at a location not overlapping each other in the same manner as the coupling portion Cn when viewed in the Z direction. According to the liquid ejection head 26 of the present embodiment, the wiring substrate 90, the first vibration absorber 53, and the second vibration absorber 54 are disposed at locations not overlapping each other at a location in the thickness direction of the flow path substrate 30. Accordingly, it is possible to avoid disposing the first vibration absorber 53 and the second vibration absorber 54 at a location according to a direction in which a load is applied to the wiring substrate 90 at the time of mounting. Thus, when the wiring substrate 90 is mounted on the flow path substrate 30 to which the first vibration absorber 53 and the second vibration absorber 54 are affixed, it is possible to avoid occurrence of abnormality that damages the first vibration absorber 53 and the second vibration absorber 54.

Meanwhile, in the liquid ejection head 26 according to the present embodiment, the coupling portion Cn is disposed to overlap at least a part of the second individual flow path 137, when the coupling portion Cn and the second individual flow path 137 are viewed in the thickness direction of the flow path substrate 30. Thereby, heat generated when a voltage is applied to the wiring substrate 90 can be dissipated via the ink flowing through the second individual flow path 137. As described above, in the liquid ejection head 26 according to the present embodiment, the second individual flow path 137 is disposed on a discharge side which is a downstream side of the nozzle Nz. Accordingly, even when the heat from the wiring substrate 90 is dissipated to the ink in the second individual flow path 137, the heat hardly reaches the ink near the nozzle Nz. Thus, influence of the heat from the wiring substrate 90 on a temperature of the ink near the nozzle Nz is reduced, and it is possible to suppress deterioration in quality during printing. As described above, in the liquid ejection head 26 according to the present embodiment, a width of the second communication path 136 in the ink flow direction D1 is substantially the same as a thickness of the flow path substrate 30. When comparing the width of the second communication path 136 in the X direction with the width of the second communication path 136 in the ink flow direction D1, the width of the second communication path 136 in the ink flow direction D1, that is, the width of the flow path substrate 30 is greater. Thereby, a distance of the ink flow path from the second individual flow path 137 to the nozzle is increased. Thus, an increase in the heat of the ink in the second individual flow path 137 is less likely to be transmitted from the second communication path 136 to the nozzle Nz.

In the liquid ejection head 26 according to the present embodiment, the first individual flow path 135 is formed such that the ink flow direction of the first individual flow path 135 becomes a direction along the X direction which is a direction perpendicular to the Z direction that is the ink ejection direction from the nozzle Nz. Thereby, since a wall surface between the individual flow paths of the plurality of liquid ejection portions 80 is obtained, the wall surface plays the same role as a beam, and thereby, strength of the flow path substrate 30 in the Z direction which is a thickness direction is enhanced. Thus, it is possible to increase a load when the wiring substrate 90 is mounted on the flow path substrate 30, and to reduce occurrence of the coupling failure between the wiring substrate 90 and an electrode.

In the liquid ejection head 26 according to the present embodiment, the ink inflow chamber 131 and the first common flow path 132 configuring the common flow path on the supply side are closed by the flexible first vibration absorber 53 over a flow path region thereof, and the second common flow path 139 and the ink discharge chamber 140 configuring the common flow path on the discharge side are closed by the flexible second vibration absorber 54 over a flow path region thereof. Accordingly, an ink supply pressure applied to the ink filled in the ink inflow chamber 131 and the first common flow path 132 is attenuated by deflection of the first vibration absorber 53. The ink supply pressure applied to the ink filled in the second common flow path 139 and the ink discharge chamber 140 and an ink ejection pressure at the time of ejecting the ink are attenuated by deflection of the second vibration absorber 54. Thereby, according to the liquid ejection head 26 of the present embodiment, it is possible to reduce occurrence of crosstalk which increases amplitudes of a vibration waveform of the pressure chamber and a vibration waveform generated by a flow of liquid.

B. Other Embodiments (B1) In the above embodiment, the first individual flow path 135 is closed by the nozzle plate 52 and is formed as an individual flow path extending in a surface direction of the nozzle plate 52. In contrast to this, the first individual flow path may not be formed, and an opening on the nozzle plate side of the first communication path and a portion on the nozzle plate side of the second communication path may be directly coupled on the nozzle plate side. According to the liquid ejection head of this embodiment, for example, by omitting the region Ar2 in FIG. 6, the nozzle plate can be further miniaturized.

(B2) In the above embodiment, the first individual flow path 135 is a concave groove formed on a lower surface side of the flow path substrate 30. In contrast to this, the first individual flow path may be provided in the nozzle plate or may be formed by a part of the nozzle plate and a part of the flow path substrate.

(B3) In the liquid ejection head 26 according to the above embodiment, one common flow path is coupled to a plurality of individual flow paths. In contrast to this, it is not always necessary to provide a plurality of individual flow paths, and one common flow path may be formed for one individual flow path. In addition, it is not always necessary to provide one common flow path, and a plurality of common flow paths may be provided. In addition, all the plurality of individual flow paths may not be coupled to one common flow path, and the plurality of individual flow paths may be divided into several groups and coupled to a plurality of common flow paths corresponding to each group, and the individual flow paths and the common flow paths may be coupled according to various combinations.

(B4) In the liquid ejection head 26 according to the above-described embodiment, the second individual flow path 137 is formed on an upper surface of the plate of the flow path substrate 30. In contrast to this, the second individual flow path may not be formed on a flow path substrate but may be formed on a pressure chamber substrate. The second individual flow path may be separated from a pressure chamber and may be formed by at least one of a part of the pressure chamber substrate and a part of the flow path substrate.

(B5) In the liquid ejection head 26 according to the above-described embodiment, the first vibration absorber 53 is a flexible planar film formed of a compliance substrate. In contrast to this, a common flow path configured by the ink inflow chamber and the first common flow path may be closed by another material such as a SUS plate without the first vibration absorber, or a wall surface may be configured by a flow path structure of the flow path substrate to close the common flow path.

(B6) In the liquid ejection head 26 according to the embodiment, the second vibration absorber 54 is a flexible planar film formed of a compliance substrate. In contrast to this, a common flow path on a discharge side configured by the ink discharge chamber and the second common flow path may be closed by another material such as a SUS plate without the second vibration absorber or may be closed by a flow path substrate. A first vibration absorber and a second vibration absorber are not necessarily formed of the same material and may be formed of separate materials, any one of the first vibration absorber and the second vibration absorber may be provided in one common flow path, and the other common flow path may be provided with a substrate having no vibration absorption performance.

(B7) In the liquid ejection head 26 according to the above-described embodiment, ink is supplied from the first supply path 133 and the pressure chamber Ch side to the first communication path 134 coupled to the nozzle Nz. In contrast to this, a supply side and a discharge side may be opposite to the supply and discharge sides of the liquid ejection head 26 according to the above-described embodiment, as in an aspect in which the ink is supplied from a second individual flow path side which is a second communication path side. The supply side and the discharge side may be switched appropriately by switching an ink supply direction using a flow mechanism provided in a liquid ejection apparatus. According to the liquid ejection head of this embodiment, by appropriately changing a circulation direction of the ink, flowability of the ink remaining near the nozzle can be improved, and thereby, it is possible to suppress occurrence of abnormality such as an increase in viscosity of the ink. The ink may be supplied from both a first supply path and a pressure chamber side, and a second individual flow path and a second communication path side. According to the liquid ejection head of this form, it is possible to increase a filling rate of a liquid near a nozzle.

(B8) The liquid ejection head 26 according to the above-described embodiment includes a common liquid chamber on a supply side in which the first common flow path 132 and the ink inflow chamber 131 are coupled to each other, and a common liquid chamber on a discharge side in which the second common flow path 139 and the ink discharge chamber 140 are coupled to each other. In contrast to this, both the common liquid chamber on the supply side and the common liquid chamber on the discharge side may not be provided together, or only one of the common liquid chambers may be provided. In an aspect in which the common liquid chambers are not included, it is preferable that flow paths of a first case member and a second case member directly communicate with a flow path of a liquid ejection portion.

(B9) In the liquid ejection head 26 according to the above embodiment, a first case member and a second case member are coupled to the flow path substrate 30. In contrast to this, the first case member and the second case member may not be coupled to the flow path substrate. In such an embodiment, an ink receiving chamber and an ink containing chamber are formed of a stacking substrate different from the first case member and the second case member such as a pressure chamber substrate and a protective member, or by separate members.

(B10) In the liquid ejection head 26 according to the above-described embodiment, the pressure chambers Ch is a concave groove formed on a lower surface of the pressure chamber substrate 40. In contrast to this, the pressure chamber may be provided on a flow path substrate. The pressure chamber may be formed by a part of the pressure chamber substrate and a part of the flow path substrate on a first communication path side of the pressure chamber substrate and the flow path substrate.

(B11) In the liquid ejection head 26 according to the above-described embodiment, the wiring substrate 90 and the nozzle plate 52 do not overlap each other in a thickness direction of the flow path substrate 30, and the drive circuit 92 and the nozzle plate 52 are also disposed at locations not overlapping each other. In contrast to this, the drive circuit and the nozzle plate may be disposed at the locations overlapping each other. In such an embodiment, the coupling portion Cn between a wiring substrate and a lead electrode and the nozzle plate may be arranged at locations where do not overlap each other.

(B12) In the liquid ejection head 26 according to the above-described embodiment, when the coupling portion Cn and the second individual flow path 137 are viewed in a thickness direction of the flow path substrate 30, the coupling portion Cn is disposed at a location where the coupling portion overlaps at least a part of the second individual flow path 137. In contrast to this, the second individual flow path and the coupling portion Cn may be disposed at locations not overlapping each other.

(B13) In the liquid ejection head 26 according to the above-described embodiment, the first individual flow path 135 is formed such that an ink flow direction of the first individual flow path 135 becomes the X direction which is perpendicular to the Z direction which is a direction of the ink ejected from the nozzle Nz. In contrast to this, an ink flow direction of a first individual flow path is not limited thereto, may not be a direction perpendicular to the direction of the ink ejected from the nozzle, and may be a direction parallel to the ink ejection direction.

(B14) In the liquid ejection head 26 according to the above-described embodiment, when comparing a width of the second communication path 136 in the X direction and a width of the second communication path 136 in the ink flow direction D1, the width of the second communication path 136 in the ink flow direction D1, that is, a thickness of the flow path substrate 30 is greater. In contrast to this, the width of the second communication path in the ink flow direction may not be substantially the same as a thickness of the flow path substrate, and the width of the second communication path in the ink flow direction may be smaller than the width of the second communication path in the X direction.

(B15) In the liquid ejection head 26 according to the above-described embodiment, the second vibration absorber 54 and the coupling portion Cn are disposed at locations not overlapping each other when viewed in the Z direction. In the same manner as in the second vibration absorber 54, the first vibration absorber 53 is also disposed at a location not overlapping with the coupling portion Cn when viewed in the Z direction. In contrast to this, either one of the first vibration absorber and the second vibration absorber may be disposed at a location overlapping the coupling portion Cn when the flow path substrate is viewed in the Z direction, or either one of the first vibration absorber and the second vibration absorber may be disposed at a location overlapping the coupling portion Cn.

C. Other Aspects

The present disclosure is not limited to the above-described embodiment and can be realized in various forms without departing from a gist thereof. For example, the present disclosure can also be realized by the following aspect. Technical features in the above-described embodiment corresponding to technical features in each of the embodiments which will be described below can be replaced or combined appropriately in order to solve a part or all of the problems of the present disclosure or in order to achieve a part or all of the effects of the present disclosure. If the technical feature is not described as essential in the present specification, the technical feature can be removed appropriately.

(1) According to one aspect of the present disclosure, a liquid ejection head having a nozzle for ejecting a liquid is provided. The liquid ejection head includes a flow path substrate including a flow path of the liquid in the flow path substrate; a nozzle plate which is attached to the flow path substrate and in which the nozzle is formed; a pressure chamber substrate that is attached to a location facing the nozzle plate with the flow path substrate interposed therebetween and that has a pressure chamber; and a pressure generation portion that operates according to an electrical signal from a wiring substrate coupled to an electrode provided on the pressure chamber substrate and that changes a pressure of the pressure chamber to eject the liquid from the nozzle. The nozzle plate and the wiring substrate may be disposed such that the nozzle plate does not overlap a coupling portion between the wiring substrate and the electrode when viewed in a thickness direction of the flow path substrate. A wiring substrate is mounted on a flow path substrate in a state where a pressure chamber substrate and a nozzle plate are stacked on a flow path substrate. At this time, a support location of a flow path substrate at the time of mounting a wiring substrate on a flow path substrate is a location of a flow path substrate in a thickness direction from a location coupling the wiring substrate to an electrode, and becomes a location facing a wiring substrate with the flow path substrate interposed therebetween. According to the liquid ejection head of this aspect, a flow path substrate and a wiring substrate are disposed at locations not overlapping each other at the locations in a thickness direction of the flow path substrate. Thus, when a wiring substrate is mounted on a flow path substrate on which a nozzle plate is mounted, it is possible to suppress occurrence of an abnormality that damages the nozzle plate or the like.

(2) In the liquid ejection head of the above-described aspect, the wiring substrate may include a drive circuit. The nozzle plate and the drive circuit may be disposed such that the nozzle plate does not overlap the drive circuit when viewed in the thickness direction of the flow path substrate. A direction in which a load is applied when a wiring substrate is mounted on a flow path substrate is often determined in a surface direction of a drive circuit mounted on the wiring substrate. According to a liquid ejection head of this aspect, the drive circuit mounted on the wiring substrate and the nozzle plate are disposed at locations not overlapping each other at a location in a thickness direction of the flow path substrate. Accordingly, it is possible to avoid disposing the nozzle plate at a location matching the direction in which the load is applied to the wiring substrate at the time of mounting. Thus, it is possible to suppress occurrence of abnormality such as damaging the nozzle plate due to a weight of the drive circuit when mounting the wiring substrate on the flow path substrate on which the nozzle plate is mounted and after the mounting.

(3) In the liquid ejection head of the above-described aspect, the flow path of the flow path substrate may include a first communication path that passes through the flow path substrate in the thickness direction and that has an opening in each of the nozzle plate side and the pressure chamber substrate side; a first individual flow path having one end side coupled to the first communication path; a second communication path that is coupled to the other end side of the first individual flow path and that extends on the pressure chamber substrate side; and a second individual flow path that is coupled to the second communication path and that extends in a surface direction of the pressure chamber substrate. According to the liquid ejection head of the aspect, even when a nozzle plate is mounted on a flow path substrate including a circulation flow path, it is possible to suppress occurrence of abnormality that damages the nozzle plate or the like when mounting a wiring substrate.

(4) In the liquid ejection head of the above-described aspect, a plurality of liquid ejection portions may be provided, each including the pressure chamber, the pressure generation portion, the first communication path, the first individual flow path, the nozzle, the second communication path, and the second individual flow path. According to the liquid ejection head of the aspect, a plurality of flow paths and nozzles are provided in one liquid ejection head. Accordingly, it is possible to eject ink from a plurality of nozzles, and to increase a resolution per liquid ejection head.

(5) In the liquid ejection head of the above-described aspect, the plurality of liquid ejection portions may be arranged in a longitudinal direction of the flow path substrate. The wiring substrate may include a plurality of the coupling portions electrically coupled to the respective pressure generation portions of the plurality of liquid ejection portions in the longitudinal direction of the flow path substrate. According to the liquid ejection head of the aspect, a plurality of liquid ejection portions are arranged in a longitudinal direction of a flow path substrate. Thereby, it is possible to avoid damage to a nozzle plate at the time of mounting a wiring substrate in the whole flow path substrate. Since a wall surface between individual flow paths for each of a plurality of liquid ejection portions is obtained, strength of the flow path substrate in a thickness direction is enhanced. Thus, it is possible to increase a load when mounting a wiring substrate on a flow path substrate, and to reduce occurrence of coupling failure between the wiring substrate and an electrode.

(6) In the liquid ejection head of the above-described aspect, the second individual flow path may be formed on an interface side between the flow path substrate and the pressure chamber substrate. The coupling portion and the second individual flow path may be disposed such that the coupling portion overlaps at least a part of the second individual flow path when viewed in the thickness direction of the flow path substrate. According to the liquid ejection head of the aspect, at least a part of a second individual flow path formed on an interface side between a flow path substrate and a pressure chamber substrate is disposed at a location overlapping a coupling portion between a wiring substrate and an electrode. Thereby, heat generated when a voltage is applied to the wiring substrate can be dissipated through a liquid flowing in the second individual flow path.

(7) In the liquid ejection head of the above-described aspect, the second individual flow path may be provided in the flow path on a discharge side of the liquid rather than the flow path coupled to the nozzle, in the flow path. In the liquid ejection head of the aspect, a second individual flow path is disposed on a discharge side that is a downstream rather than a nozzle. Accordingly, even when heat generated from a wiring substrate is dissipated to a liquid in the second individual flow path, influence on a temperature of the liquid near the nozzle is reduced, and it is possible to suppress quality deterioration at the time of printing.

(8) In the liquid ejection head of the above-described aspect, a flow direction of the liquid in the first individual flow path may be a direction perpendicular to an ejection direction of the liquid from the nozzle. According to the liquid ejection head of the aspect, since a wall surface between individual flow paths of each of a plurality of liquid ejection portions is obtained, strength of a flow path substrate in a thickness direction is enhanced. Thus, it is possible to increase a load when mounting a wiring substrate on the flow path substrate and to reduce occurrence of coupling failure between the wiring substrate and an electrode.

(9) In the liquid ejection head of the above-described aspect, the first individual flow path may be formed on an interface side between the flow path substrate and the nozzle plate and extends in a surface direction of the nozzle plate. According to the liquid ejection head of the aspect, it is possible to provide a miniaturized nozzle plate by forming a mounting seat for mounting a first plate on a flow path substrate.

(10) In the liquid ejection head of the above-described aspect, a width of the second communication path in a flow direction of the liquid may be greater than a width perpendicular to the flow direction of the liquid of the second communication path. According to the liquid ejection head of the aspect, a rise in heat of a liquid in a second individual flow path received from a wiring substrate is less likely to be transmitted from a second communication path 136 to the nozzle Nz.

(11) In the liquid ejection head of the above-described aspect, the pressure generation portion may be provided on a surface of the pressure chamber substrate on a side opposite to a side having the pressure chamber. According to the liquid ejection head of the aspect, a distance between a wiring substrate and a pressure generation portion is shortened to facilitate a coupling with an electrode.

(12) In the liquid ejection head of the above-described aspect, the flow path substrate may include a first common flow path communicating with each of a plurality of the pressure chambers; and a second common flow path communicating with each of a plurality of the second individual flow paths on a side opposite to the second communication path. According to the liquid ejection head of the aspect, one common flow path is coupled to a plurality of individual flow paths. Thereby, it is possible to increase a filling rate of a liquid in each individual flow path.

(13) In the liquid ejection head of the above-described aspect, in the first common flow path, a first vibration absorber reducing a pressure fluctuation of the liquid in the first common flow path may be disposed at a location that is a part of an inner wall of the first common flow path. In the second common flow path, a second vibration absorber reducing a pressure fluctuation of the liquid in the second common flow path may be disposed at a location that is a part of an inner wall of the second common flow path. According to the liquid ejection head of the aspect, it is possible to increase compliance in a common flow path and to suppress occurrence of crosstalk when ejecting a liquid.

(14) In the liquid ejection head of the above-described aspect, the first vibration absorber and the second vibration absorber may be disposed at locations where the first vibration absorber and the second vibration absorber do not overlap the coupling portion when viewed in a thickness direction of the flow path substrate. According to the liquid ejection head of the aspect, it is possible to suppress occurrence of abnormality that damages the first vibration absorber and the second vibration absorber or the like, when a wiring substrate is mounted on a flow path substrate on which a first vibration absorber and a second vibration absorber are mounted.

(15) In the liquid ejection head of the above-described aspect, the nozzle plate may be a silicon substrate. According to the liquid ejection head of the aspect, a nozzle of the nozzle plate can be processed with a high accuracy.

(16) According to another aspect of the present disclosure, a liquid ejection apparatus is provided. The liquid ejection apparatus includes the liquid ejection head of the respective aspects; and a flow mechanism moving the liquid through the flow path.

(17) According to another aspect of the present disclosure, a method of manufacturing a liquid ejection head having a nozzle for ejecting a liquid is provided. The method of manufacturing the liquid ejection head stacks a flow path substrate including a flow path of the liquid in the flow path substrate, a nozzle plate which is attached to the flow path substrate and in which the nozzle is formed, a pressure chamber substrate that is attached to a location facing the nozzle plate with the flow path substrate interposed therebetween and that has a pressure chamber, and a pressure generation portion that operates according to an electrical signal from a wiring substrate including an electrical coupling portion coupled to an electrode provided on the pressure chamber substrate and that changes a pressure of the pressure chamber to eject the liquid from the nozzle. The method mounts the wiring substrate at a location where the nozzle plate and a coupling portion of the electrode to the wiring substrate do not overlap each other when viewed in a thickness direction of the flow path substrate.

The present disclosure can be realized in various forms other than a liquid ejection head or a liquid ejection apparatus. For example, the present disclosure can be realized by aspects, such as a method of manufacturing the liquid ejection head or the liquid ejection apparatus, a method of controlling the liquid ejection head or the liquid ejection apparatus, a computer program for realizing the control method, a non-transitory storage medium storing the computer program, and the like. The present disclosure is not limited to the liquid ejection apparatus that ejects ink and can also be applied to any liquid ejection apparatus that ejects a liquid other than the ink. For example, the present disclosure can be applied to various liquid ejection apparatuses as follows. The present disclosure can be realized by aspects such as an image recording apparatus such as a facsimile apparatus, a color material ejection apparatus used for manufacturing a color filter for an image display apparatus such as a liquid crystal display, an electrode material ejection apparatus used for electrode formation such as an organic electro luminescence (EL) display and a field emission display (FED), a liquid ejection apparatus of ejection a liquid containing a bioorganic matter used for manufacturing a biochip, a sample ejection apparatus as a precision pipette, a lubricating oil ejection apparatus, a resin liquid ejection apparatus, a liquid ejection apparatus ejecting a lubricating oil into a precision machine such as a watch or a camera at pinpoints, a liquid ejection apparatus ejecting a transparent resin liquid such as an ultraviolet curable resin liquid onto a substrate to form a micro-hemispherical lens (optical lens) or the like used for an optical communication element or the like, a liquid ejection apparatus ejecting an acidic or alkaline etching solution to etch a substrate or the like, a liquid ejection apparatus including a liquid ejection head for ejecting a droplet of any other minute amount, and the like.

What is claimed is:

1. A liquid ejection head having a nozzle for ejecting a liquid comprising:

a flow path substrate including a flow path of the liquid in the flow path substrate;

a nozzle plate which is attached to the flow path substrate and in which the nozzle is formed;

a pressure chamber substrate that is attached to a location facing the nozzle plate with the flow path substrate interposed therebetween and that has a pressure chamber; and a pressure generation portion that operates according to an electrical signal from a wiring substrate coupled to an electrode provided on the pressure chamber substrate and that changes a pressure of the pressure chamber to eject the liquid from the nozzle, wherein the nozzle plate and the wiring substrate are disposed such that the nozzle plate does not overlap a coupling portion between the wiring substrate and the electrode when viewed in a thickness direction of the flow path substrate, and wherein the coupling portion overlaps a gap formed between where the nozzle plate contacts the flow path substrate and a portion where a first vibration absorber that acts as a wall for the flow path contacts the flow path substrate.

2. The liquid ejection head according to claim 1, wherein the wiring substrate includes a drive circuit, and the nozzle plate and the drive circuit are disposed such that the nozzle plate does not overlap the drive circuit when viewed in the thickness direction of the flow path substrate.

3. The liquid ejection head according to claim 1, wherein the flow path of the flow path substrate including a first communication path that passes through the flow path substrate in the thickness direction and that has an opening in each of the nozzle plate side and the pressure chamber substrate side, a first individual flow path having one end side coupled to the first communication path, a second communication path that is coupled to the other end side of the first individual flow path and that extends on the pressure chamber substrate side, and a second individual flow path that is coupled to the second communication path and that extends in a surface direction of the pressure chamber substrate.

4. The liquid ejection head according to claim 3, wherein a plurality of sets of liquid ejection portions are provided, each including the pressure chamber, the pressure generation portion, the first communication path, the first individual flow path, the nozzle, the second communication path, and the second individual flow path.

5. The liquid ejection head according to claim 4, wherein the plurality of liquid ejection portions are arranged in a longitudinal direction of the flow path substrate, and the wiring substrate includes a plurality of the coupling portions electrically coupled to the respective pressure generation portions of the plurality of liquid ejection portions in the longitudinal direction of the flow path substrate.

6. The liquid ejection head according to claim 3, wherein the second individual flow path is formed on an interface side between the flow path substrate and the pressure chamber substrate, and the coupling portion and the second individual flow path are disposed such that the coupling portion overlaps at least a part of the second individual flow path when viewed in the thickness direction of the flow path substrate.

7. The liquid ejection head according to claim 6, wherein the second individual flow path is provided in the flow path on a discharge side of the liquid rather than the flow path coupled to the nozzle, in the flow path.

8. The liquid ejection head according to claim 3, wherein a flow direction of the liquid in the first individual flow path is a direction perpendicular to an ejection direction of the liquid from the nozzle.

9. The liquid ejection head according to claim 3, wherein the first individual flow path is formed on an interface side between the flow path substrate and the nozzle plate and extends in a surface direction of the nozzle plate.

10. The liquid ejection head according to claim 3, wherein a width of the second communication path in a flow direction of the liquid is greater than a width perpendicular to the flow direction of the liquid of the second communication path.

11. The liquid ejection head according to claim 3, wherein the pressure generation portion is provided on a surface of the pressure chamber substrate on a side opposite to a side having the pressure chamber.

12. The liquid ejection head according to claim 3, wherein the flow path substrate including a first common flow path communicating with each of a plurality of the pressure chambers, and a second common flow path communicating with each of a plurality of the second individual flow paths on a side opposite to the second communication path.

13. The liquid ejection head according to claim 12, wherein in the first common flow path, a second vibration absorber reducing a pressure fluctuation of the liquid in the first common flow path is disposed at a location that is a part of an inner wall of the first common flow path, and in the second common flow path, the first vibration absorber reducing a pressure fluctuation of the liquid in the second common flow path is disposed at a location that is a part of an inner wall of the second common flow path.

14. The liquid ejection head according to claim 13, wherein the first vibration absorber and the second vibration absorber are disposed at locations where the first vibration absorber and the second vibration absorber do not overlap the coupling portion when viewed in a thickness direction of the flow path substrate.

15. A liquid ejection apparatus comprising:

the liquid ejection head according to claim 1; and a flow mechanism moving the liquid through the flow path.

16. A liquid ejection head comprising:

a nozzle plate in which a nozzle for ejecting a liquid is formed;

a pressure chamber substrate including a pressure chamber for communicating with the nozzle, and a drive element for generating a pressure fluctuation of the liquid in the pressure chamber; and a wiring substrate, wherein the nozzle plate is disposed on a first surface side of the pressure chamber substrate so as to overlap the pressure chamber substrate in a plan view, wherein an electrode drawn out from the drive element is formed on a second surface of the pressure chamber substrate opposite to the first surface, wherein a coupling point between the electrode and the wiring substrate does not overlap the nozzle plate in a plan view, and wherein the coupling point overlaps a gap formed between where the nozzle plate contacts a flow path substrate and a portion where a vibration absorber that acts as a wall for a flow path contacts the flow path substrate.

17. A method of manufacturing a liquid ejection head having a nozzle for ejecting a liquid, the method comprising:

stacking a flow path substrate including a flow path of the liquid in the flow path substrate, a nozzle plate which is attached to the flow path substrate and in which the nozzle is formed, a pressure chamber substrate that is attached to a location facing the nozzle plate with the flow path substrate interposed therebetween and that has a pressure chamber, and a pressure generation portion that operates according to an electrical signal from a wiring substrate including an electrical coupling portion coupled to an electrode provided on the pressure chamber substrate and that changes a pressure of the pressure chamber to eject the liquid from the nozzle, and mounting the wiring substrate at a location where the nozzle plate and a coupling portion of the electrode to the wiring substrate do not overlap each other when viewed in a thickness direction of the flow path substrate, wherein the coupling portion overlaps a gap formed between where the nozzle plate contacts the flow path substrate and a portion where a vibration absorber that acts as a wall for the flow path contacts the flow path substrate.

* * * * *